US007722507B2

(12) United States Patent
Yoo

(10) Patent No.: US 7,722,507 B2
(45) Date of Patent: May 25, 2010

(54) INCLINATION CONTROLLING DEVICE OF TREADMILL

(75) Inventor: Seon-Kyung Yoo, Seoul (KR)

(73) Assignee: Tobeone Company Limited, Seoul (KR)

( * ) Notice: Subject to any disclaimer, the term of this patent is extended or adjusted under 35 U.S.C. 154(b) by 919 days.

(21) Appl. No.: 10/544,740

(22) PCT Filed: Feb. 20, 2004

(86) PCT No.: PCT/KR2004/000349

§ 371 (c)(1),
(2), (4) Date: Jul. 21, 2006

(87) PCT Pub. No.: WO2004/073805

PCT Pub. Date: Sep. 2, 2004

(65) Prior Publication Data

US 2007/0004561 A1 Jan. 4, 2007

(30) Foreign Application Priority Data

Feb. 21, 2003 (KR) ..... 10-2003-0011094

(51) Int. Cl.
*A63B 22/02* (2006.01)

(52) U.S. Cl. ..... 482/54; 482/51

(58) Field of Classification Search ..... 482/51, 482/54; 119/700
See application file for complete search history.

(56) References Cited

U.S. PATENT DOCUMENTS

| | | | | |
|---|---|---|---|---|
| 4,984,810 | A | 1/1991 | Stearns et al. | |
| 6,179,753 | B1 * | 1/2001 | Barker et al. | 482/54 |
| 6,261,209 | B1 | 7/2001 | Coody | |
| 6,273,843 | B1 | 8/2001 | Lo | |
| 6,579,211 | B2 * | 6/2003 | Wu | 482/54 |
| 6,974,404 | B1 * | 12/2005 | Watterson et al. | 482/54 |
| 2004/0138030 | A1 * | 7/2004 | Wang et al. | 482/54 |

FOREIGN PATENT DOCUMENTS

KR 2002-0018784 3/2002

* cited by examiner

*Primary Examiner*—Glenn Richman
(74) *Attorney, Agent, or Firm*—Wenderoth, Lind & Ponack L.L.P.

(57) ABSTRACT

The present invention provides a inclination controlling device of treadmill comprising a belt support frame, a first link member pivotally connected to the belt support frame, a second link member pivotally connected to the belt support frame, and a base frame pivotally connected to both the first link member and the second link member respectively thereby controlling an inclination angle of the belt support frame with wider range.

19 Claims, 8 Drawing Sheets

INCLINATION CONTROLLING DEVICE OF TREADMILL

CROSS-REFERENCE TO RELATED APPLICATION

The present application claims the benefit of Korea Patent application No. 2003-0011094 filed Feb. 21, 2003, which is hereby incorporated by reference in its entirety.

BACKGROUND OF THE INVENTION

I. Field of Invention

The present invention relates to an exercise apparatus in general and, more particularly, to an inclination controlling device of a treadmill and foldable treadmill using the same, the treadmill inclination angle can be controlled more widely including a downward inclination as well as an upward inclination in order to enable users to run or walk on the treadmill in various conditions.

II. Description of Related Art

A treadmill known as a running machine is widely used indoors such as at home or in a sports center as it allows users to have an effect of exercising while working or running on its endless rotating belt in a narrow space. Recently, the demand for treadmills is drastically increasing due to the advantages of its safety and convenience because users can exercise indoors using the treadmill even in the cold winter.

Users of a treadmill can strengthen their cardiopulmonary function and leg muscles, and can control their weight by consuming calories efficiently while running or walking on a treadmill. To maximize this exercise effect, a treadmill with an inclination controlling device has been produced lately.

A treadmill comprises a foot plate which upholds load resulting from users, a belt rotating endlessly around the footplate on which users can run or walk continuously, an operating motor for the belt, a holding post used as arm supports while exercising, an inclination controlling device which supports the load of the footplate and controls the inclination.

As illustrated in FIG. 1, the conventional treadmill 1 includes a support frame 10 which upholds weight or impact by running or walking thereon, a link member 20 pivotally connected to one end 11 of the support frame for rotating relative to the support frame 10, a fixed member 30 which is connected to the support frame 10 to uphold a rear part of the support frame 10, a base 40 pivotally connected to one end 21 of the link member 20 for rotating and settling on the ground, an actuator 50 which connects the base 40 with the link member 20.

The fixed member 30 has one end 31 welded to a support frame 10, the other end 32 which maintains a constant angle with a ground, and a roller 32*a* on the ground movable with a support frame 10 according to an operation of the actuator 50.

The actuator 50 has one end 51*a* pivotally connected to a link member 20 for rotating relative to the link member 20 and can control an inclination angle of the support frame 10 by means of contracting or extending a bar 51 because the bar 51 controls an angle between the link member 20 and the base 40 thereby allowing the link member 2 to rotate relative to the base 40.

In the conventional treadmill shown at FIG. 1 as described above, the angle θ between the link member 20 and the base 40 gets smaller and the height of the joint 11 gets lower while the bar 51 of the actuator 50 is being contracted. On the contrary, while the bar 51 is being extended, the angle θ gets bigger and the height of a joint 11 gets higher. As a result, the treadmill can have various slope for running or walking.

However, the inclination controlling device of the conventional treadmill counts on a height deviation amount of the joint 11 caused by a rotation of the link member 20 in view of controlling the inclination angle of the support frame because the distance from the joint 11 to the ground is consistent regardless of operation of the actuator 50. Therefore, the conventional treadmill is limited in that it cannot control the inclination angle in a wide range.

Besides, the fixed member 30 should be formed short to make a steep inclination angle in the conventional inclination controlling device. But in this case, the conventional treadmill cannot substantially provide a downward inclination because of the short length of the fixed member 30. Moreover, in the case of the steep inclination of the support frame 10, moments are concentrated near the actuator 50 thereby causing weakening of the durability of links.

SUMMARY OF INVENTION

As a solution for the above problem, the present invention is designed to provide an inclination controlling device of a treadmill, having an inclination angle that can be controlled in a wide range including a downward inclination, as well as an upward inclination in order to enable users to exercise in various exercise conditions.

Another purpose of the present invention is to provide an inclination controlling device of a treadmill with enhanced durability by means of preventing load or impact by users from being concentrated on a specific member.

The present invention also enables protection of joints (such as a knee joint) of users from excessive impact when using a treadmill.

To achieve these and other advantages and in accordance with the purpose of the present invention, as embodied and broadly described herein, an inclination controlling device comprising a belt support frame, a first link member which is pivotally connected to the belt support frame, a second link member which is pivotally connected to the belt support frame and positioned at a regular interval from the first link member, a base which is pivotally connected to both the first link member and the second link member relatively for rotating, and an actuator to let the belt support frame move relative to the base frame is provided.

And thus, it enables control of the inclination of the belt support frame with a wider range because the inclination controlling device of the treadmill is formed as a four link structure pivotally connecting the belt support frame, the first link member, the base frame and second link member to one another. That is, a second pivotal joint connecting the belt support frame with the second link member goes down when a first pivotal joint connecting the belt support with the first link member goes up, and, likewise, the second pivotal joint goes up when the first pivotal joint goes down. Accordingly the inclination connecting the first pivotal joint with the second pivotal joint can be realized in a wider range.

In addition, due to the four-link structure with four pivotal joints, impact on a footplate during exercise can be absorbed in the pivotal joints or transformed to elastic energy in each member so that reactive impacts on a user's knee and ankle joint during exercise can be minimized.

Herein, it is preferable that the first link member is longer than the second link member because different lengths of the links connecting the belt support frame with the base frame permit the inclination to be controlled widely and easily.

It is desirable that the angle between the first link member and the base frame is an acute angle defined between 5° and 60° and the angle between the second link member and the base frame is defined between 75° and 90° when the first pivotal joint is positioned nearest to the base frame.

Moreover, when the first pivotal joint is positioned nearest to the base frame, the first pivotal joint is positioned lower than the second pivotal joint so that users can enjoy running or working on a downward inclination condition.

Besides, when the first pivotal joint is positioned furthest from the base frame, the first pivotal joint is higher than the second pivotal joint so that users can enjoy running or working on an upward inclination condition.

Herein, it is preferable that the angle between the first link member and the base frame is defined either between 35° and 50° or between 75° and 90°. When the angle between the first link member and the base frame is within the range between 0° and 45°, the first pivotal joint can be higher with an efficient rate. And when the angle between the first link member and the base frame reaches 90°, the steepest inclination is embodied. It can suit the user's taste in exercise through installing of the ranges of the angle in manufacturing process by adjusting the fit with conditions in advance in which the users want to exercise.

Also, in view of controlling the inclination angle of the belt support frame, it is desirable that the actuator is operated by contraction or extension of the bar, wherein the actuator is pivotally connected on the base frame and one end of the operating bar can be pivotally connected to one of the first link member, the second link member and the belt support frame.

Meanwhile, the actuator includes a motor, a pinion engaged with the motor and driven by the motor, and a transfer gear engaged with both the pinion and the first link member, wherein the transfer gear can be engaged with the second link member instead of the first link member.

The treadmill device has a holding post having a handle and the base frame is pivotally connected to the holding post for rotating relative to the holding post thereby enabling users to keep the treadmill folded in a narrow space when it is not in use.

On the other hand, the present invention provides a foldable treadmill comprising a footplate; an inclination controlling device including a belt support frame upholding the footplate and controlling an inclination angle of the footplate, a first link member pivotally connected to the belt support frame, a second link member pivotally connected to the belt support frame, a base frame pivotally connected to the first link member and the second link member respectively; a holding assembly including a holding post longitudinally set up, a support connected to the lower end of the holding post; a hinge formed at the holding assembly for letting said inclination controlling device rotate relative to the holding assembly. And thus, users can keep the treadmill folded in a narrow space when it is not in use.

It is preferable that the hinge is formed rotatably connecting the holding post with the base frame.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 2 is a perspective view illustrating the inclination controlling device of a treadmill in accordance with the present invention.

FIG. 3 is an exploded view illustrating the inclination controlling device of a treadmill in accordance with the present invention.

FIG. 4 is a side view illustrating the inclination controlling device of a treadmill in accordance with the present invention.

FIG. 5 is a side view illustrating an upward inclination by the inclination controlling device of a treadmill in accordance with the present invention.

FIG. 6 is a side view illustrating a downward inclination by the inclination controlling device of a treadmill in accordance with the present invention.

FIG. 7 is a perspective view illustrating a treadmill with the inclination controlling device in accordance with the present invention.

FIG. 8 is a perspective view illustrating the treadmill folding the inclination controlling device.

DETAILED DESCRIPTION OF THE INVENTION

Figure 1:
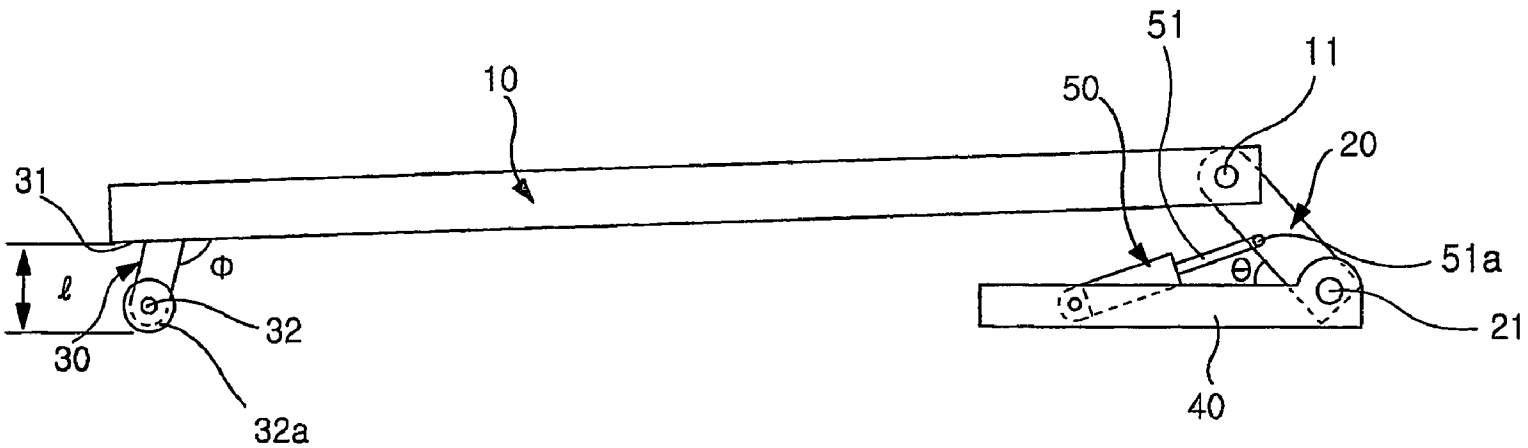
FIG. 1 is a perspective view illustrating an inclination controlling device of a conventional treadmill.
Figure 2:
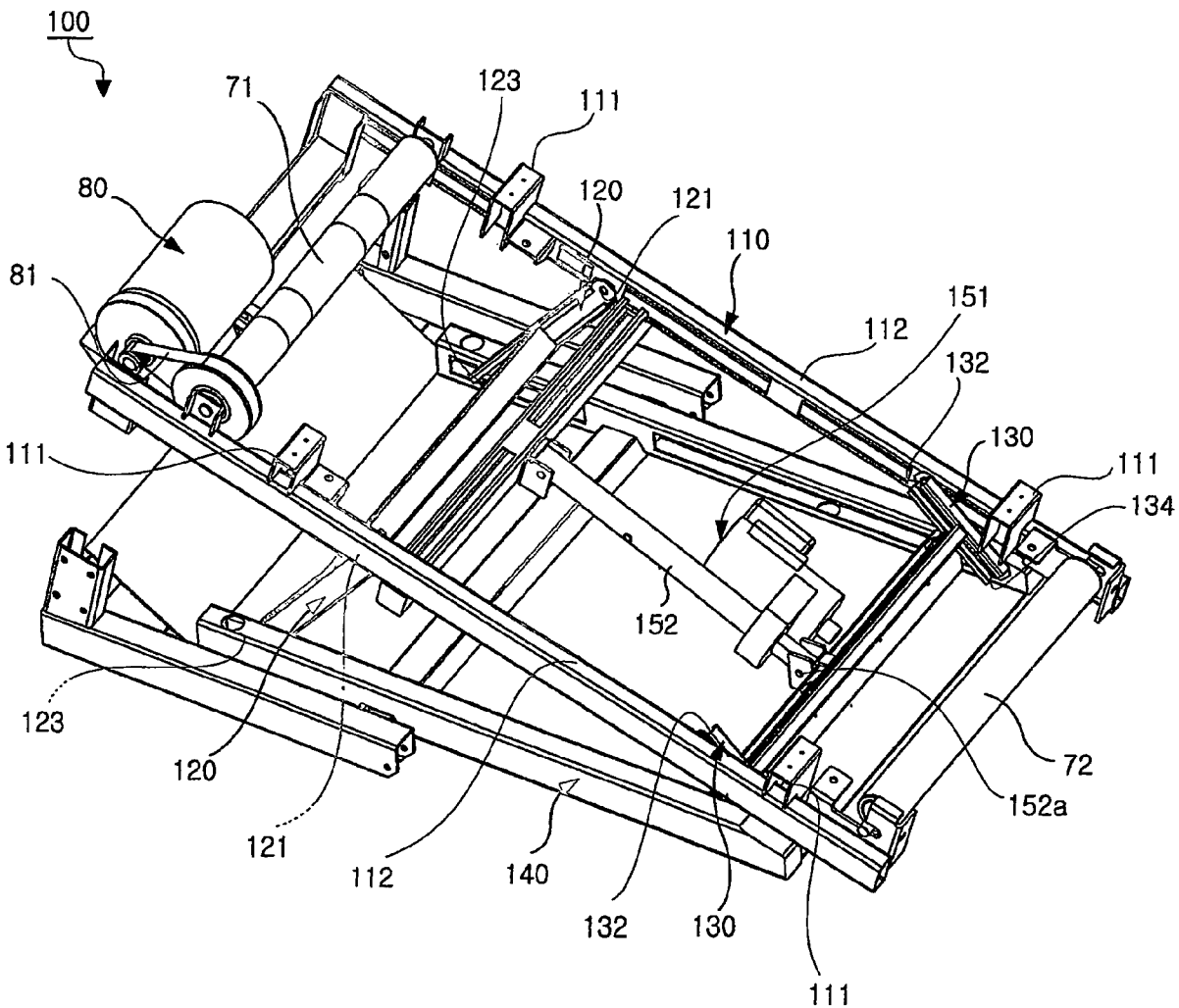
FIG. 2 through FIG. 8 relates to an inclination controlling device of a treadmill in accordance with the first embodiment of the present invention.
Figure 3:
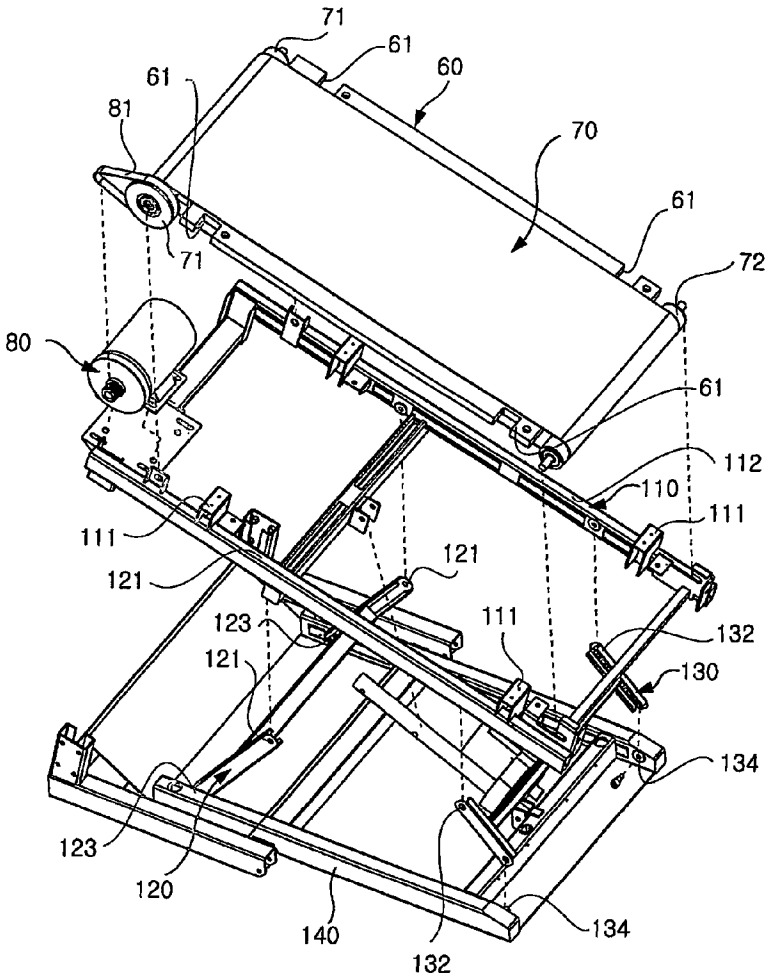

Reference will now be made in detail to the preferred embodiments of the present invention, examples of which are illustrated in the accompanying drawings.

FIG. 2 through FIG. 8 illustrate a treadmill with an inclination controlling device in accordance with the first embodiment of the present invention that comprises a footplate 60, a belt 70 that moves around the footplate endlessly, a motor 80 driving the belt to rotate via a connection belt 81, and an inclination controlling device that upholds loads or impacts on the footplate 60 and controls an inclination angle of the footplate 60.

Herein, the inclination controlling device 100 thereof has a belt support frame 110 which upholds the footplate 60 loaded by users, a first link member 120 pivotally connected to one side of the belt support frame 110 for rotating, a second link member 130 pivotally connected to the other side for rotating at a regular interval from first link member 120, a base frame 140 pivotally connected to both the first link member 120 and the second link member 130 respectively, and an actuator 150 pivotally connected to the base frame 140 letting the controlled belt support frame 110 to move relative to the base frame 140.

The belt support frame 110 has a rectangular form to securely hold the footplate 60 from loads and impacts. That is, protrusions 111 around four edges of the rectangular form in the belt support frame 110 are fit to convex portions 61 of the footplate 60.

The first link member 120 includes a first pivot joint 121 which is pivotally connected to one side of the belt frame 110 for rotating, and a third pivot joint 123 which is pivotally connected to one side of the base frame 140 for rotating.

The second link member 130 includes a second pivot joint 132 which is pivotally connected to the belt support frame 110 at an interval of d1 from the first pivot joint 121, and a fourth pivot joint 134 which is pivotally connected to one side of the base frame 140 at an interval of d2 relative to the base frame 140 for rotating.

Laid on the ground horizontally, the base frame 140 has a foldable hinge pivotally connected to one side of a holding assembly 90 thereby enabling the treadmill to be folded when it is not use. And the base frame 140 is connected to one side to the first link member 120 and to the second link member 130 at the interval of d2 respectively.

The actuator 150 includes a driving part 151 and a bar 152 formed as a leadscrew whose one end is inserted into the driving part 151 and engaged with the driving part 151 in proper length. Therefore, as the driving part 151 rotates, the bar 152 gets contracted or extended according to the rotation direction of the driving part 151. Herein, one end of actuator 150 (driving part 151) is pivotally connected to the base frame 140 and one end 152*b* of the bar 152 is pivotally connected to the belt support frame 110, so that an inclination angle of the belt support frame 110 can be controlled as the driving part 151 rotates and the bar 152 gets contracted or extended.

As described above, the belt support frame 110, the first link member 120, the second link member and the base frame 140 make up a trapezoid-shaped four-link structure and rotate relative to each other. Preferably, the first link member 120 is much longer than the second link member 130 in order to control the inclination angle of the belt support frame 110 with a wider range, thereby attaining a steep inclination.

Figure 4:
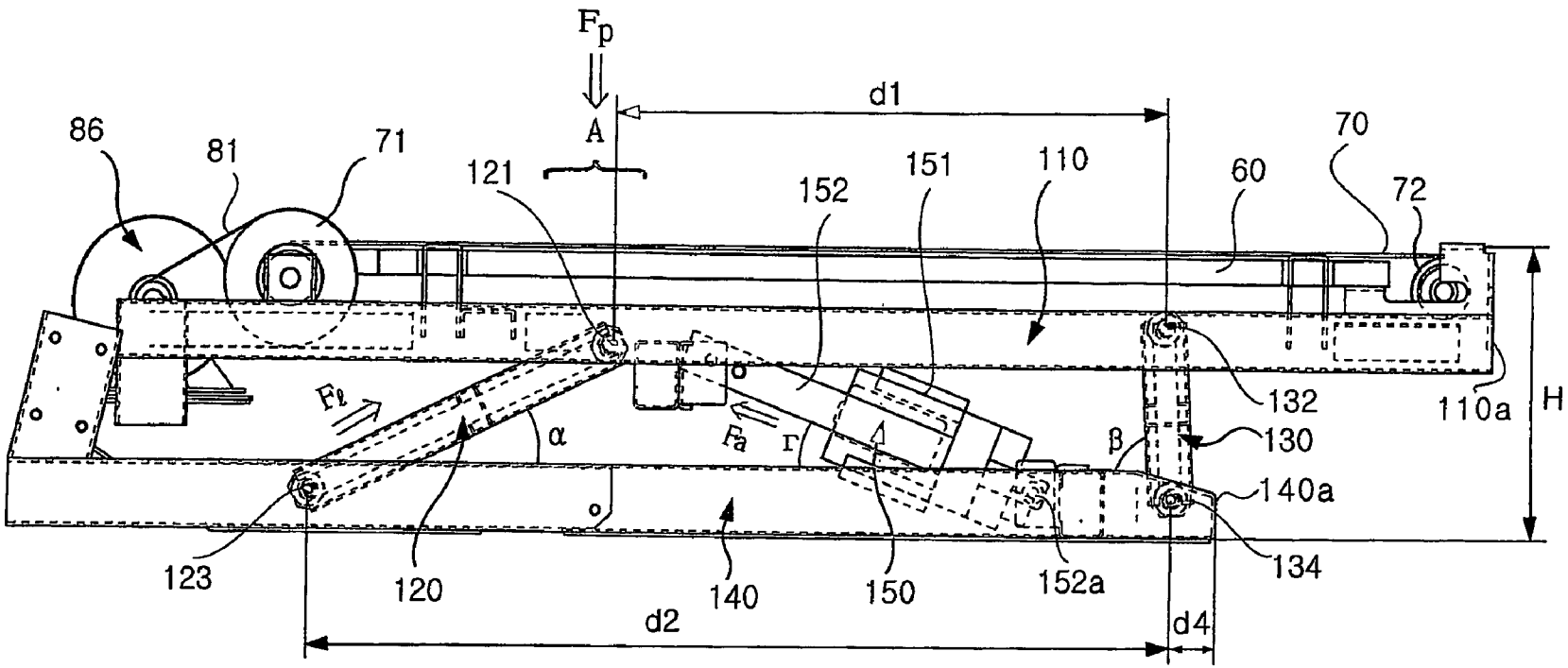

In the horizontal condition of the belt support frame shown in FIG. 4, it is preferred that the belt support frame 110 poses as low as possible. However, in the case that the belt support frame 110 poses too low in the horizontal condition, excessive stress could be concentrated on the first link member 120 and the bar 152. Therefore, it is desirable to maintain the proper distance H between the belt support frame 110 and the ground. Concretely, the distance H is preferably 100 mm to 250 mm to satisfy both conditions properly.

In addition, during running or walking on a treadmill, most of the loads or impacts by a user are mainly concentrated on a front portion A of the belt support frame 110. In the conventional inclination controlling devices 1, such concentrated loads damage or trouble the treadmill, since the loads are transmitted and concentrated on the actuator 50 and the link members 20. However, in the inclination controlling device in accordance with the first embodiment of the present invention, illustrated in FIG. 4, the loads Fp by a user are distributed to the first link member 120 and the bar 152, respectively, as an amount of reaction force F1, Fa of a sine component of the angle α, γ. Furthermore, even though there is a little difference caused by values of angle α and the angle γ, the force component in a horizontal direction is set off and a moment does not work on the base frame 140. That is, the inclination controlling device of the present invention makes external forces from the user shared effectively, and thus each member 110,120,130,140 making up the four-link structure has an improved durability thereby removing the possibility of breakage. Moreover, the inclination controlling device can be manufactured with reduced cost by applying a lower capacity of actuator 150 thereto, and users can run or walk on the treadmill with the inclination controlling device feeling more comfortable due to properly shared external forces.

It is also possible to design the ratio of d1 over d2 variously where d1 is a distance from the first pivotal joint 121 to the second pivotal joint 132, and d2 is a distance from the third pivotal joint 123 to the fourth pivotal joint 134. When d1 is equal to d2, the external force will be distributed effectively, but this will cause the inclination angle to not be able to be controlled. That is, the belt support frame 110 is always parallel to the base frame 140. When d1 is much longer than the d2, the external force can not be shared effectively while the wide range of an inclination is angle can be controlled. Therefore, there exists an optimized ratio of d1 over d2 (d1/d2). Preferably, the ratio of d1 over d2 is defined between 0.3 and 0.9 to harmonize both the control range of the inclination angle and the effective external load sharing.

It is desirable that the second link member 130 is pivotally fixed at a point which is very close to the end of base frame 140. That is, d4 shown in FIG. 4 is defined between 25 mm and 80 mm in view of improving the load sharing characteristics and durability.

Referring to the FIG. 2 through FIG. 6., components shown as 71, 72 are rollers to guide and drive the belt 70 to rotate endlessly around the footplate 60, a component shown as 91 is a handle formed at the end of holding post 90, and a component shown as 92*a* is a control panel showing exercise conditions.

Hereinafter, an operation mechanism in accordance with the first embodiment will be readily apparent by the following description referring to FIG. 4 through FIG. 6.

Figure 6:
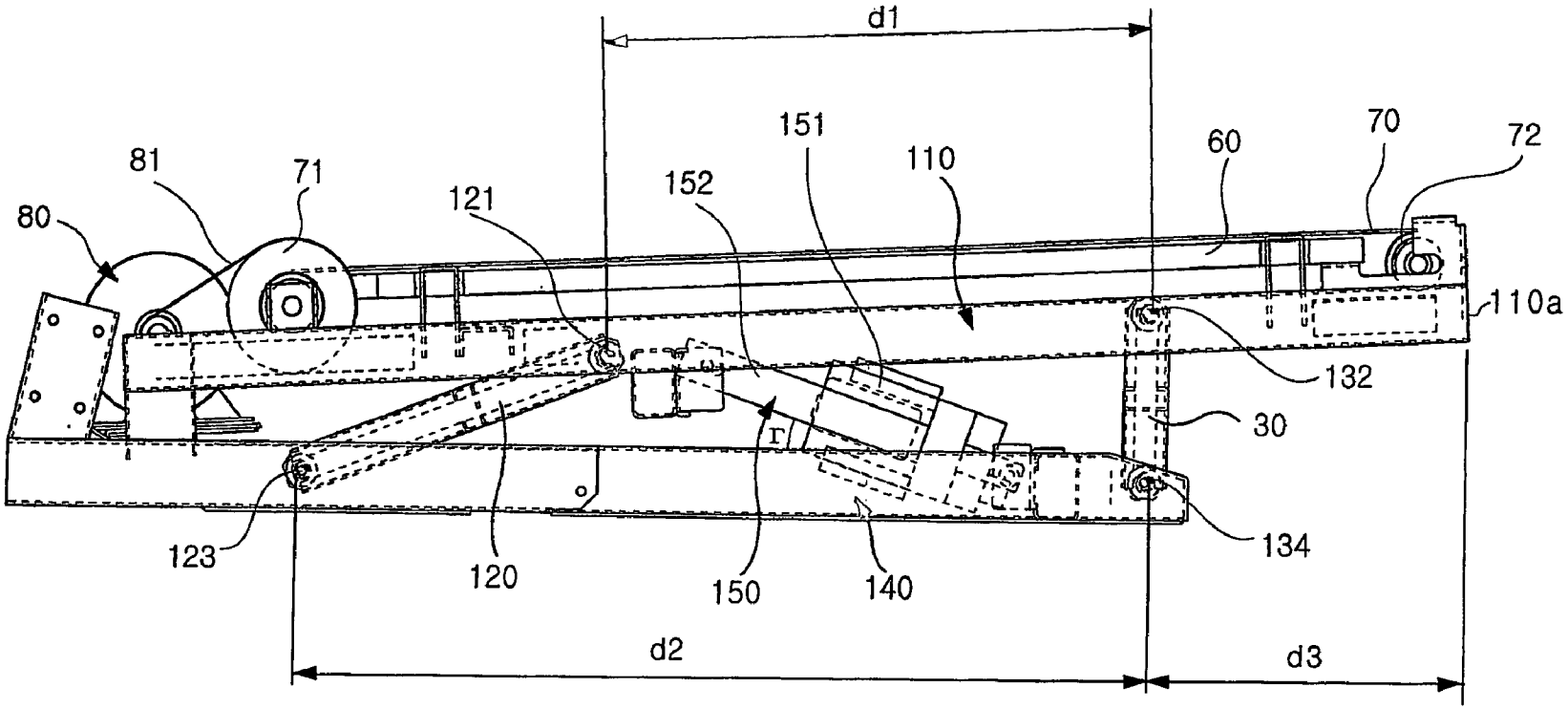
Figure 7:
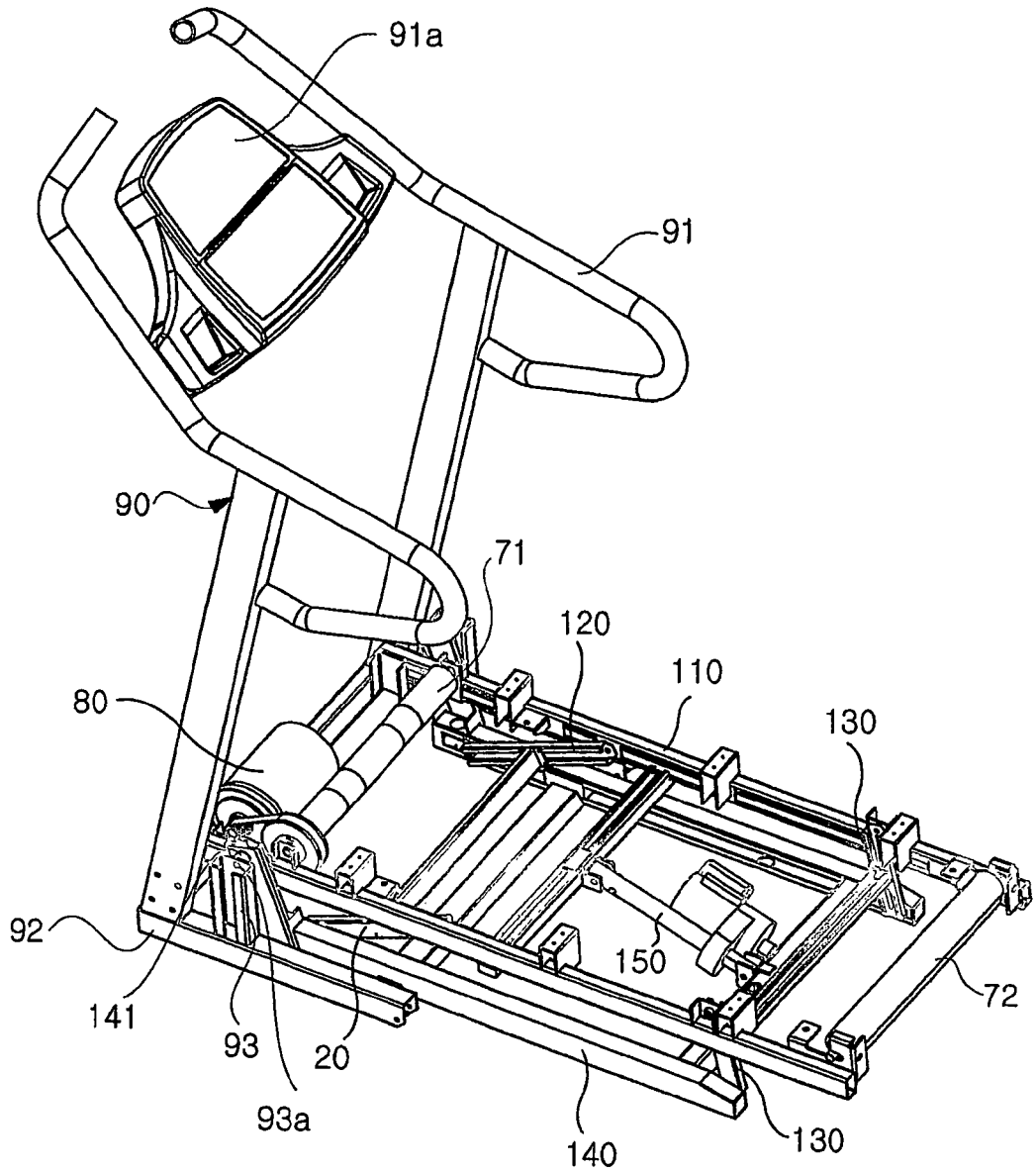
Figure 8:
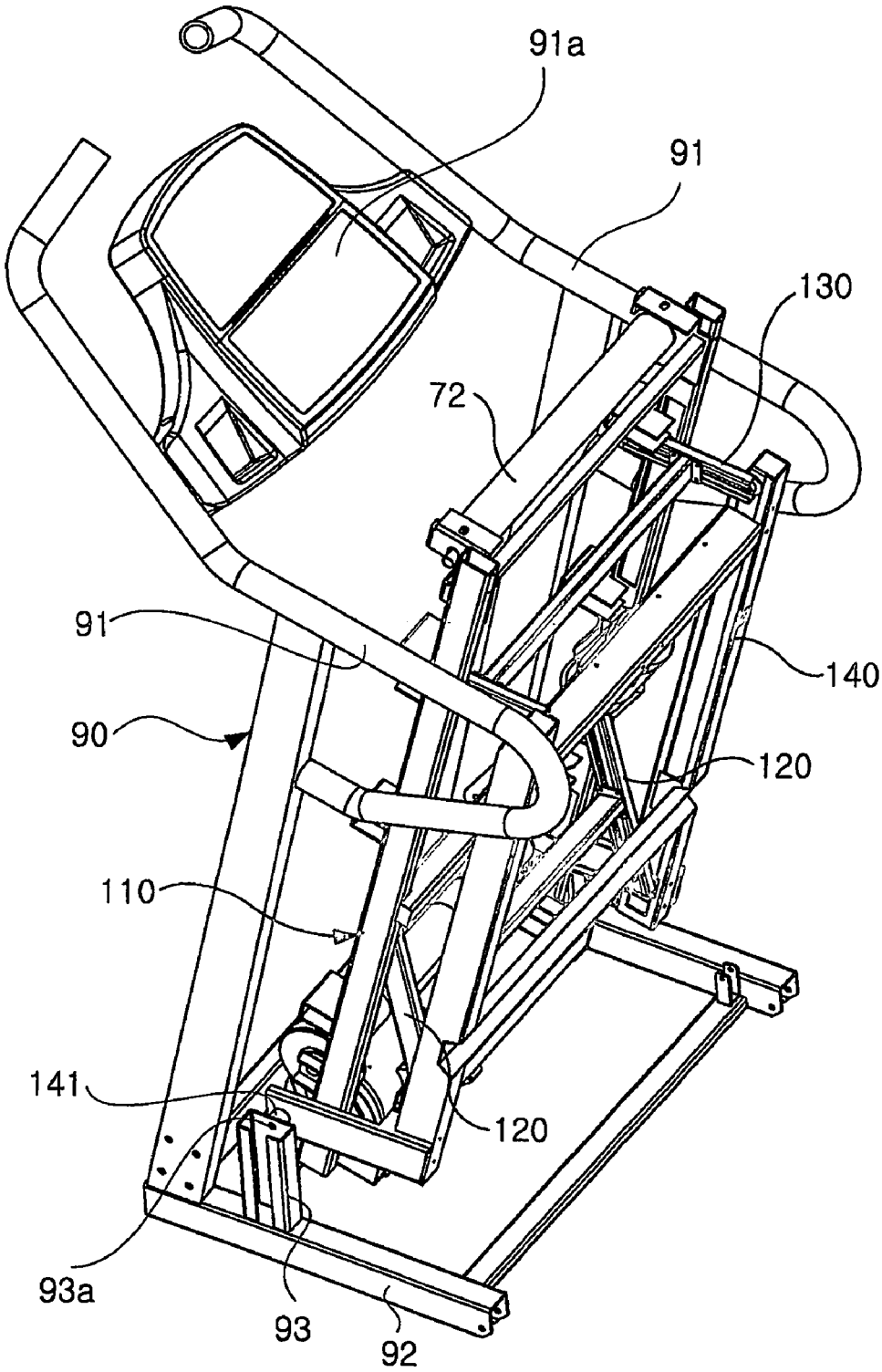

Illustrated in FIG. 6, when the first pivotal joint 121 is positioned nearest to the base frame 140, that is, when a length of the bar 152 of the actuator 150 is the shortest, a height of the first pivotal joint 121 is lower than that of the second pivotal joint 132 thereby realizing downward inclination by the inclination controlling device of a treadmill. Herein, an angle β between the second link member 130 and base frame 140 is 90° while an angle α between the first link member 120 and base frame 140 is an acute angle between 5° and 60°. More specifically, it is preferable that the angle α is defined between 5° and 30° in order to realize steeper downward inclination, and that the angle α is defined between 30° and 60° in order to realize steeper upward inclination.

Preferably, the angle β is less than 90° in that the second pivot joint 132 is getting higher and then lower when the second link member 130 is rotating over 90° thereby causing the footplate 60 to be fluctuated, which results in an concentration of stresses on the first link member 120 and the second link member 130, causing unpleasantness to users.

Figure 5:
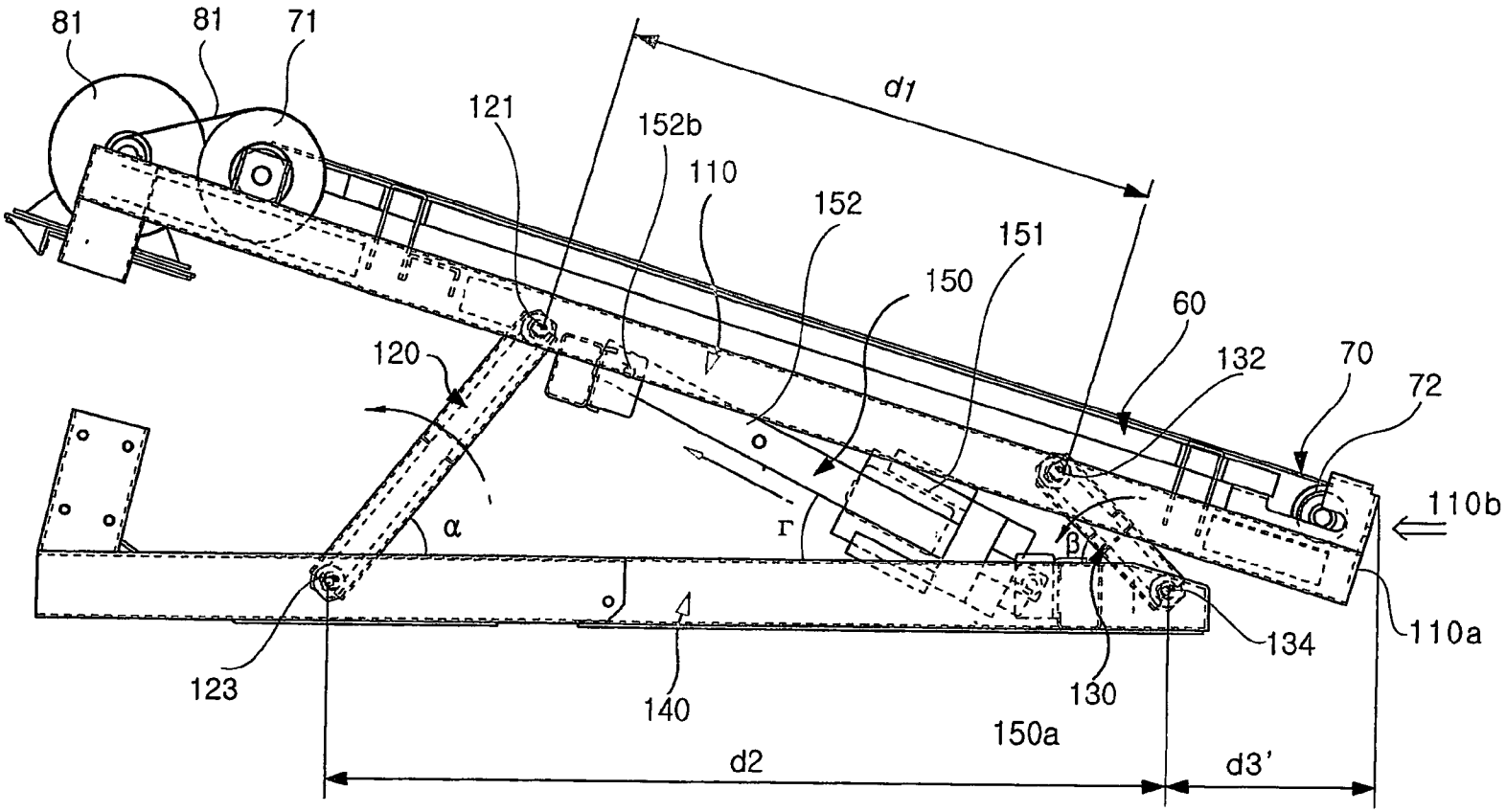

As shown in FIG. 5, when the bar 152 is extended by operating the actuator 150, the angle β gets smaller within the range less than 90° and the height of the second pivot joint 132 gets lower. Simultaneously, the angle α gets bigger and the height of the first pivot joint 121 gets higher. Accordingly, the inclination angle of the belt support frame 110 is converted to a plus value (upward inclination) from a minus value (downward inclination) as the bar 152 is extended, and then significantly steep upward inclination can be realized according to the extension amount of the bar 152.

Herein, it is preferable that the angle α is defined either between 35° and 50° or between 75° and 90° when the bar 152 of the actuator 150 is extended maximally. More concretely, the first pivot joint 121 can be higher with an efficient rate for the amount of rotation Δα of the first link member 120 within the range between 0° and 45°. When the angle between the first link member and the base frame reaches 90°, the steepest slope is embodied. It can suit the user's taste in exercise through installing the ranges of α in the manufacturing process by adjusting the fit with conditions in advance in which users want to exercise. More specifically, when some users want to enjoy running in a downward inclination condition, as well as, an upward inclination, i.e. in the wide range of inclination angles, the maximum value of the angle α is preferably 45°. Likewise, when other users want to enjoy running or walking in a very steep upward inclination, the maximum value of the angle α is preferably 90°.

As the bar 152 of the actuator 150 gets extended, the belt support frame 110 moves in the direction of 110*b*. That is, the belt support frame moves in the direction of 110*b* by a length of d3-d3' as the second link member 130 rotates by the amount of rotation (β. (Herein, d3' in FIG. 5 becomes shorter than d3 in FIG. 6). Considering that users tend to move forward to grasp a handle 91 when the inclination of the footplate 60 goes up, the inclination controlling device 100 enables users to feel more comfortable and keep exercising on the footplate 60 even when the inclination of the footplate 60 is going up gradually. In general, the treadmill should be equipped with the footplate 60 long enough for the users' exercise radius. Meanwhile the inclination controlling device can have a shorter footplate 60 by the length of d3-d3' when the inclination of the footplate 60 goes up, thereby saving a space for the treadmill.

The inclination controlling device 100 in accordance with the present invention provides versatility from a downward inclination to a significant steep upward inclination according to contraction or extension of the bar 152 so that user can feel more satisfaction with enjoying various exercise conditions.

As explained above, the inclination controlling device 100 in accordance with the present invention is formed as a four-link structure by pivotally connecting the belt support frame 110, the first link member 120, the second link member 130 and the base frame 140 to one another. Therefore, in controlling the inclination angle of the belt support frame, when the first pivot joint 121 is rising from the base frame 140, the second pivot joint 132 is contrariwise dropping toward the base frame 140. Likewise when the first pivot joint 121 is dropping toward the base frame 140, the second pivot joint 132 is contrariwise rising from the base frame 140, thereby controlling the inclination angle widely.

In addition, having the four-link structure with the four pivotal joints 121,123,132,134 pivotally connecting link members 110,120,130,140 to one another can absorb external impacts or forces on the footplate 60 during an exercise by transforming external impacts or forces into elastic energy of link members 110,120,130 bent slightly or damping on each pivotal joints 121,123,132,134, thereby minimizing the reactive impacts on user's knee or ankle joint.

The actuator 150 also limits the movement of the four-link structure, as illustrated in the first embodiment where the actuator is pivotally connected to the base frame 140 and one end of the bar 152 is pivotally connected to the belt support frame 110. Meanwhile, one end of the bar 152, constituting an actuator, can be connected to either the first link member 120 or the second link member 130, instead of the belt support frame 110 without any change of effect.

Although the current embodiment detailed above deals with inclination controlling device with a bar type actuator, as far as the four-link structure is included in the treadmill inclination controlling device, the present invention also includes an inclination controlling device manually operated with a handle, and an inclination controlling device applying other types of actuators comprising a pinion driven by a motor, a transfer gear engaged with both the pinion and the first link member (or the second link member) instead of bar type actuator.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An inclination controlling device for a treadmill comprising:

a belt support frame having a front part and a rear part;

a first link member pivotally connected to said belt support frame at said front part of said belt support frame, so as to enable relative rotation therebetween;

a first pivotal joint connecting said first link member with said belt support frame, said first pivotal support joint being configured to move in accordance with the relative rotation between said first link member and said belt support frame;

a second link member pivotally connected to said belt support frame at said rear part of said belt support frame, so as to enable relative rotation therebetween;

a second pivotal joint connecting said second link and said belt support frame, said second pivotal joint being configured to move in accordance with the relative rotation between said second link member and said belt support frame; and a base frame pivotally connected to both said first link member and said second link member, said base frame and said first link forming a rear angle therebetween, wherein the length of said second link member is shorter than the length of said first link member, and wherein the rear angle between said first link member and said base frame is less than 90 degrees.

2. The inclination controlling device for a treadmill according to claim 1, wherein the rear angle between said first link member and said base frame is between 5° and 60°, when said first pivotal joint is positioned at a position proximal to said base frame.

3. The inclination controlling device for a treadmill according to claim 1, wherein said second link and said base frame form an angle, and the angle between said second link member and said base frame is between 75° and 90°, when said first pivotal joint is positioned at a position proximal to said base frame.

4. The inclination controlling device for a treadmill according to claim 1, wherein said first pivotal joint is positioned lower than said second pivotal joint, when said first pivotal joint is positioned at a position proximal to said base frame.

5. The inclination controlling device for a treadmill according to claim 1, wherein said first pivotal joint is positioned higher than said second pivotal joint, when said first pivotal joint is positioned at a position distal from said base frame.

6. The inclination controlling device for a treadmill according to claim 5, wherein the rear angle between said first link member and said base frame is 75° or greater and less than 90°, when said first pivotal joint is positioned at a position distal from said base frame.

7. The inclination controlling device for a treadmill according to claim 5, wherein the rear angle between said first link member and said base frame is between 35° and 50°, when said first pivotal joint is positioned at the position distal from said base frame.

8. The inclination controlling device for a treadmill according to claim 1, wherein the ratio of d1 over d2 is defined between 0.3 and 0.9 where d1 is a distance between said first pivotal joint and said second pivotal joint, and d2 is a distance between a third pivotal joint connecting said first link member with said base frame and a fourth pivotal joint connecting said second link member with said base frame.

9. The inclination controlling device for a treadmill according to claim 1, wherein said base frame has a bottom side and said belt support frame has an upper side, and the distance from said bottom side of said base frame to said upper side of said belt support frame is between 100 mm and 250 mm when said base frame is parallel to said belt support frame.

10. The inclination controlling device for a treadmill according to claim 1, further comprising a fourth pivotal joint connecting said second link member with said base frame, said fourth pivotal joint being positioned between 25 mm and 80 mm from an end of said base frame.

11. The inclination controlling device for a treadmill according to claim 1, further comprising an actuator driving said belt support frame relative to said base frame.

12. The inclination controlling device for a treadmill according to claim 11, wherein said actuator includes:

a motor;

a pinion engaged with said motor and driven by said motor; and a transfer gear engaged with both said pinion and said first link member.

13. The inclination controlling device for a treadmill according to claim 11, wherein said actuator includes:

a motor;

a pinion driven in engagement with said motor; and a transfer gear engaged with both said pinion and said second link member.

14. The inclination controlling device for a treadmill according to claim 11, wherein said actuator is operated by contraction or extension of a bar.

15. The inclination controlling device for a treadmill according to claim 14, wherein said actuator is fixed to said base frame.

16. The inclination controlling device for a treadmill according to claim 14, wherein said actuator is fixed to said base frame, and one end of said bar is connected to said first link member.

17. The inclination controlling device for a treadmill according to claim 14, wherein said actuator is fixed to said base frame, and one end of said bar is connected to said second link member.

18. The inclination controlling device for a treadmill according to claim 14, wherein said actuator is fixed to said base frame, and one end of said bar is connected to said belt support frame.

19. The inclination controlling device for a treadmill according to claim 1, wherein said treadmill has a holding post having a handle; and said base frame is pivotally connected to said holding post for rotating relative to said holding post.

* * * * *